United States Patent [19]

Wang

[11] Patent Number: 4,783,726

[45] Date of Patent: Nov. 8, 1988

[54] MODULAR LIGHT DEVICE

[76] Inventor: Chern J. Wang, No. 199, Sec.1, Hua Mei Si St., Taichung City, Taiwan

[21] Appl. No.: 62,438

[22] Filed: Jun. 12, 1987

[51] Int. Cl.[4] ..... F21P 1/00

[52] U.S. Cl. ..... 362/252; 362/226; 362/806; 439/642

[58] Field of Search ..... 362/252, 226, 121, 806, 362/807; 439/638, 641, 642, 643, 645, 646, 648

[56] References Cited

U.S. PATENT DOCUMENTS

| | | | |
|---|---|---|---|
| 1,977,126 | 10/1934 | Graf | 362/252 |
| 2,172,757 | 9/1939 | Pollock | 362/252 |
| 3,400,263 | 9/1968 | Yakim | 362/252 |
| 3,977,746 | 8/1976 | Seibold | 439/646 |
| 4,339,787 | 7/1982 | Burnbaum | 362/252 |
| 4,667,277 | 5/1987 | Hanchar | 362/252 |

FOREIGN PATENT DOCUMENTS

| | | | |
|---|---|---|---|
| 302147 | 5/1915 | Fed. Rep. of Germany | 362/806 |
| 26294 | 6/1923 | France | 362/252 |

*Primary Examiner*—James C. Yeung

[57] ABSTRACT

A light device is designed to have a light holder which has a socket and a connector piece. The socket of one light device can be inserted in the connector piece of another light device so that the light devices can be connected successively to one another to form various pattern.

3 Claims, 6 Drawing Sheets

MODULAR LIGHT DEVICE

BACKGROUND OF THE INVENTION

This application relates to a decorative light device, and particularly to a modular decorative light device with an improved lamp holder, and a plurality of the same which can be interconnected successively so as to constitute a variety of assemblies.

It is known to provide a decorative light device which has a plurality of lamps arranged annularly as shown in FIG. 1. Such a light device includes a lamp holder with a neck which can be connected electrically to a socket. The lamp holder thereof does not permit the light device to be used as a repeating unit so as to constitute a plurality of assemblies with varying patterns.

SUMMARY OF THE INVENTION

An object of the invention is to provide a modular light device a plurality of which can be easily connected in succession to each other to form a variety of patterns.

The invention provides a light device which comprises: a socket having a first conductive hollow member having a closed end, an open end, an internal thread, and a first electric contact element mounted on the closed end and insulated electrically from the closed end; a bell-shaped member including a tapered end with a threaded hollow neck portion extending from the tapered end, the hollow neck being inserted threadedly in the first hollow member, a flared end having a plurality of first channel members extending radially from the flared end, each channel member having a groove extending radially; a lamp holding annular plate member having a plurality of lamp holding plates extending radially from the annular member, each lamp holding plate having a lamp mounted thereon and conductors disposed thereon, the lamp being received in one of the grooves and the conductors being connected electrically to the socket; a connector means having a second conductive hollow member with a closed end, an open end, and a second electric contact element, the second hollow member being inserted through the lamp holding annular member into the bell-shaped member and connected electrically to the socket and the conductors, the connector capable of receiving and being in electrical connection with the first hollow member of another light device so as to achieve successive connection of the light devices; and an annular cover member secured to the bell-shaped member and having a plurality of second channel members extending radially from the periphery of the annular cover member, each channel plate member having a groove, the cover member and the bell-shaped member cooperating to hold firmly the lamp holding members.

In one aspect of the invention, the first hollow has an external thread on the periphery, and the second hollow member has an internal thread and an external thread, wherein the first hollow member can be fitted threadedly into the second hollow member, and the first and second contact elements can be in contact with one another.

In another aspect of the invention, the first hollow member further has two diametrically opposite protrusions on its outer periphery, and the second hollow member has a cylindrical wall in which are provided two diametrically opposite engaging holes near the open end of the second hollow member, the protrusions of the first hollow member being capable of engaging in the engaging holes when the first hollow member is inserted in the second hollow member, wherein the second hollow member further has a plate member which is normal to the longitudinal axis of the second hollow member and mounted movably in the second hollow member, and a spring urging said plate towards the open end of the connector means.

The present exemplary preferred embodiment will be described in detail with reference to the following drawings, in which:

DETAILED DESCRIPTION OF THE PREFERRED EMBODIMENT

Figure 1:
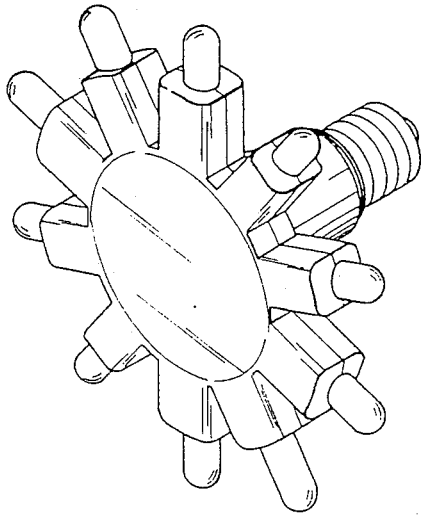
PRIOR ART FIG. 1
FIG. 1 is a perspective view of a conventional light device.
Figure 2:
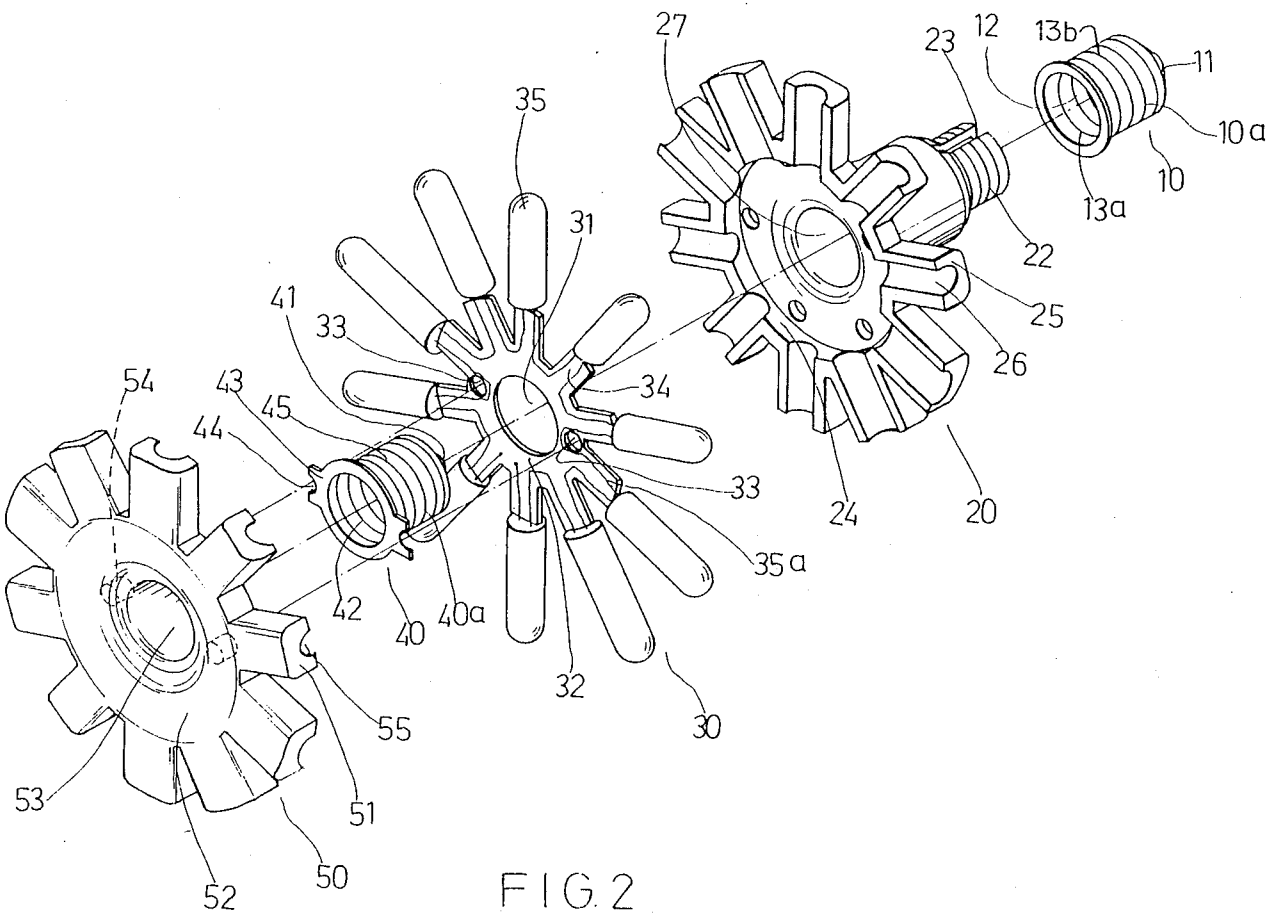
FIG. 2 is an exploded view of a first preferred embodiment of the present invention.
Figure 3:
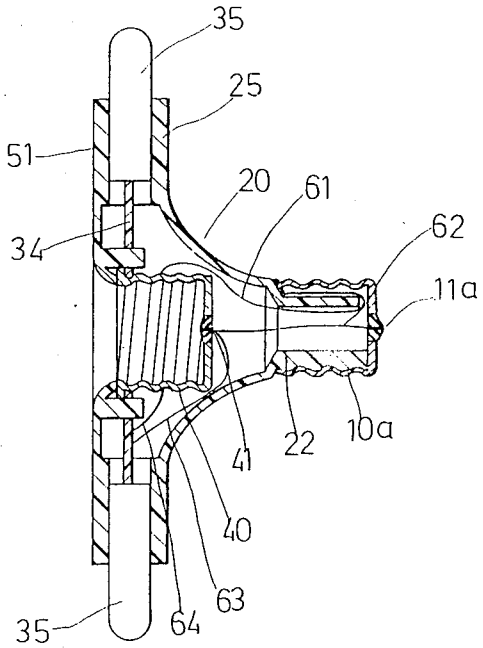
FIG. 3 is a sectional view of the first embodiment.
Figure 4:
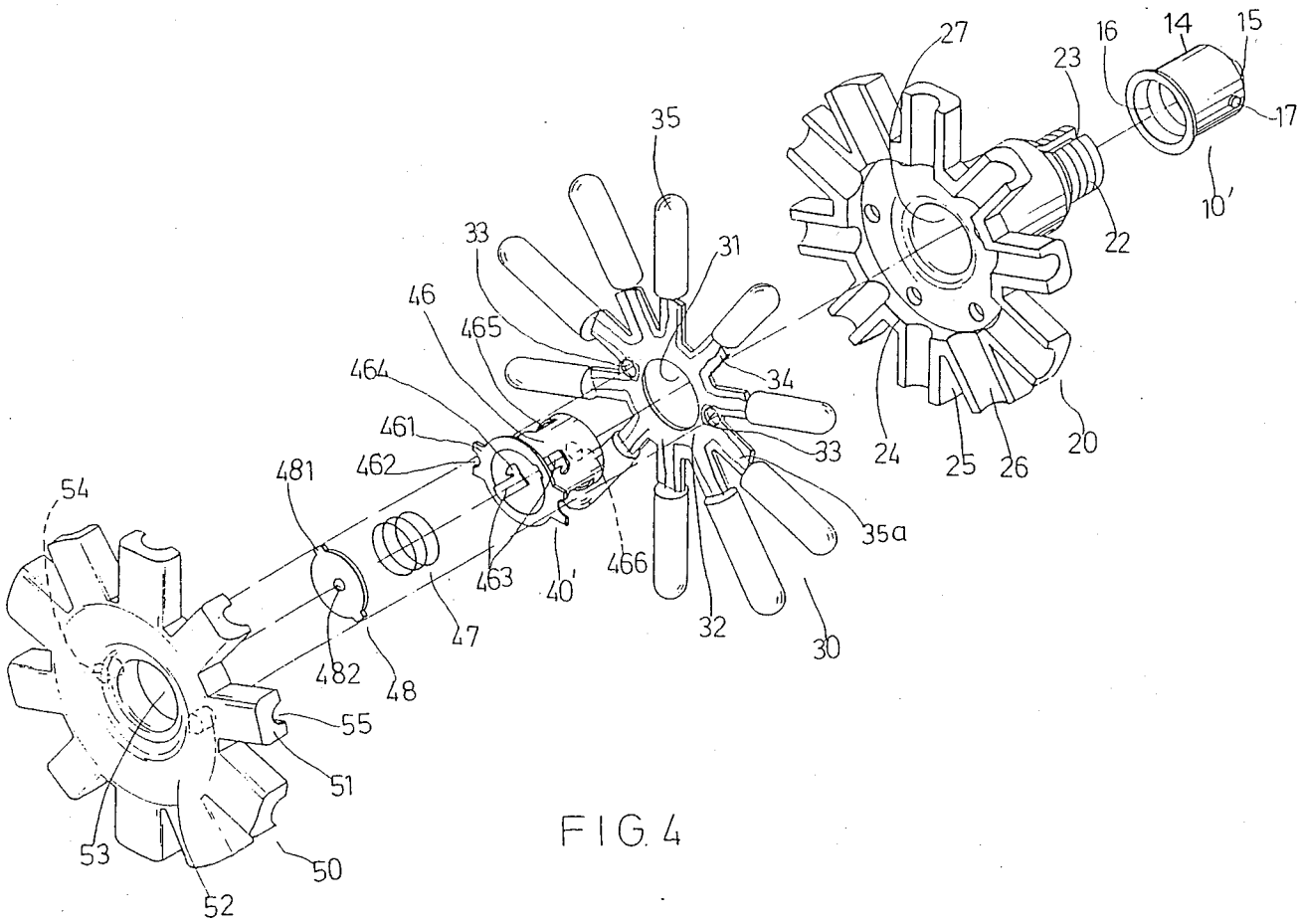
FIG. 4 is an exploded view of a second embodiment.

Referring to FIGS. 2, 3 and 4, a decorative light device is shown, including a socket 10 having a first hollow member 10*a* with a closed end 11, an open end 12, an internal thread 13*a* and an external thread 13*b*. An electric contact member 11*a* is attached to and insulated from the closed end 11. To the hollow member 10*a* is attached a bell-shaped member 20 which has a threaded neck 22 extending from its tapered end. An axial slit 23 is provided in the threaded neck 22. A pluraltiy of channel members 25 each with a groove 26 extend radially from the flanged end 24 of the bell-shaped member 20. Member 20 has an axial passage 27.

There is a lamp holding means 30 which includes an annulr plate member 32 with a centeral opening 31 and a plurality of lamp holding plates 34 extending radially. On each lamp holding plate 34 is mounted a lamp 35. The annular plate member 32 of the lamp holding means 30 is sleeved around a connector means 40. On the lamp holding plates 34 are provided printed-circuit conductors 35*a*, and each lamp 35 is received in one of the grooves 26.

The connector means 40 has a cylindrical hollow member 40a with a closed end, an open end, an internal screw thread 42 and an external screw thread 45. At the open end of the cylindrical hollow member 40*a* is an annular flange from which extend two diametrically opposite lugs 43 with notches 44.

There is an annular cover member 50 having a plurality of radial channel members 51 each having a groove 55. The annular cover member 50 has a flanged end 52 and two pin members 54 which are to be inserted into two holes 33 of the lamp holding means 30 passing through the notches 44 of the connector means 40. An axial passage 53 extends through member 50.

In assembly, the lamp holding annular plate 30 is sleeved onto the hollow member 40*a* and abuts with 20 the flange 43 of the hollow member 40*a*. The notches 44 on the flange 43 are registered with the holes 33 of the annular plate 30. Then, the lamp holding means 30 and the connector means 40 are placed between the cover plate 50 and the bell-shaped member 20, and the cover plate 50 and the bell-shaped member 20 are bonded adhesively together, thereby holding securely the lamp holding means 30 in the cover plate 50 and the bell-shaped member 20. The lamps 35 are held in respective pairs of the grooves 26 and 55. The pins 54 of the cover plate 50 extend through the notches 44 into the holes 33 of the annular plate 32. Finally, the hollow neck 22 of the belled-shaped member 20 is threaded into the socket 10.

Referring to FIG. 3, the conductor 35*a* on the lamp holding means 30 has two terminals (not shown) which are respectively connected electrically to the cylindrical wall of the hollow member 40*a* and the contact member 41 through wires 63 and 64. The hollow member 40*a* and the contact member 41 are in turn connected electrically to the hollow member 10*a* of the socket 10, and the contact element 11*a* through wires 61 and 62. The wire 61 is soldered to the inner side of the wall of the hollow member 10*a*, passing through the slit 23 of the neck 22 of the bell-shaped member 20. When a light device as described is to be connected to a next light device, the connector 40 of the light device is sleeved threadedly on the socket 10 of the next light device until their contact elements 11*a* and 41 contact with one another, thereby connecting electrically the two light devices together. By connecting the light devices in succession, various patterns of light can be obtained.

FIG. 4 shows a second embodiment of the present invention, in which the elements which are the same as those of the first embodiment are represented by the same reference numerals. The second embodiment differs from the first embodiment in that it includes a connector means 40' instead of the connector means 40, and a socket 10' instead of the socket 10. The socket 10' is a cylindrical hollow member 14 with an open end and a closed end. The inner side of the hollow member 14 is provided with an internal thread 16. At the closed end of the hollow member 14 is an electric contact element 15. Two protrusions 17 project from the periphery of the hollow member 14 at two diametrically opposing positions.

The connector means 40' includes a cylindrical hollow member 46 which has a flange at its open end with two diametrical lugs 461 in which are provided respectively notches 462. At the closed end of the cylindrical hollow member 46 is an opening 466. In the periphery of the cylindrical hollow member 46 are two diametrically opposing openings 465 and two diametricallt opposite engaging holes 463. Each engaging hole 463 has an angled end for engagement. There are a spring 47 and a circular plate 48 in the hollow member 46. The circular plate 48 has two opposite projections 481 and a central electric contact 482, and is put into the hollow member 46 with its opposite projections 481 extending into the openings 465. The plate 48 is urged by the spring 47 so that the projections 481 abut against the edges of the openings 465.

Figure 5:
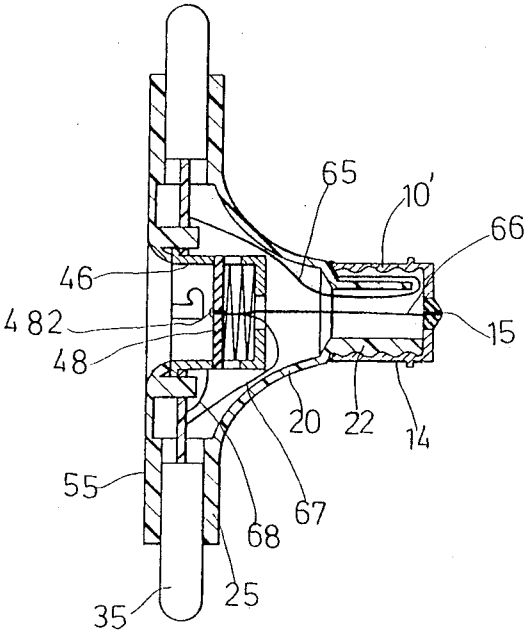
FIG. 5 is a sectional view of the second embodiment.

As shown in FIG. 5, two terminals of the conductor 34*a* are connected electrically to the contact element 482 of the plate 48 and the wall of the hollow member 46 through wires 67 and 68. A wire 65 connects the contact element 482 to the contact element 15 of the socket 10', and a wire 66 connects the wall of the hollow member 46 to the wall of the hollow member 14.

It can be noted that the socket 10' of the light device can be inserted into the connector 40' of another light device by engaging the protrusions 17 of the socket 10' in the angled end of the engaging holes 463 of the connector 40'. In this situation, the contact element 482 of the plate 48 is urged by the spring 47 to contact against the contact element 15 of the socket 10'.

Figure 6:
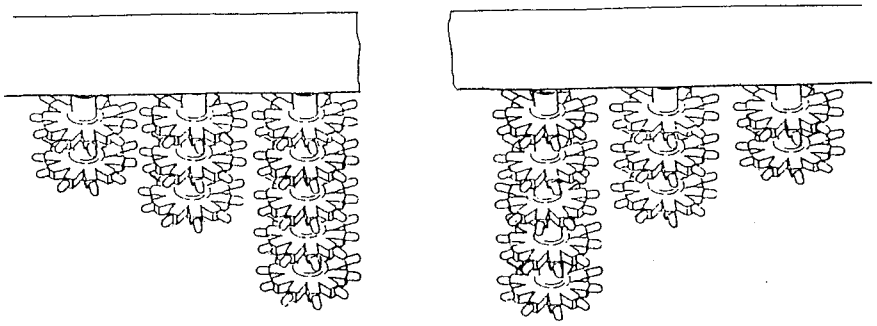
FIG. 6 shows a pattern of light formed by assembly of the light devices of the present invention.

FIG. 6 illustrates the manner in which the lighting devices of the present invention can be connected together. The light devices are physical and electrically connected by means of the sockets and connectors.

With the invention thus explained, it is apparent that various modifications and variations can be made without departing from the scope of the invention. It is therefore intended that the invention be limited as indicated in the appended claims.

What I claim is:

1. A light device comprising:

a socket having a first conductive hollow member having a closed end, an open end, an internal thread, and a first electric contact element mounted on said closed end and insulated electrically from said closed end;

a bell-shaped member including a tapered end with a threaded hollow neck portion extending from said tapered end, said hollow neck being inserted threadedly in said first hollow member, and a flared end having a plurality of first channel members extending radially from said flared end, each of said channel members having a groove extending radially;

a lamp holding means having an annular plate member and a plurality of lamp holding plates extending radially from said annular plate member, each of said lamp holding plates having a lamp mounted thereon and conductors disposed thereon, said lamps being received in one of said grooves and said conductors are connected electrically to said socket;

a connector having a second conductive hollow member with a closed end, an open end, and a second electric contact element, said second hollow member being inserted through said lamp holding annular member into said bell-shaped member and connected electrically to said socket and said conductors, said connector capable of receiving and being in electrical connection with said first hollow member of another said light device so as to achieve successive connection of said light devices; and an annular cover member secured to said bell-shaped member and having a plurality of second channel members extending radially from the periphery of said annular cover member, each of said channel plate members having a groove, said annular cover member and said bell-shaped member cooperating to hold firmly said lamp holding means.

2. A light device as claimed in claim 1, in which said first hollow member further has an external thread on its periphery, and said second hollow member has an internal thread and an external thread, wherein said first hollow member can be fitted threadedly into said second hollow members, and said first and second contact elements can be in contact with one another.

3. A light device as claimed in claim 1, in which said first hollow member further has two diametrically opposite protrusions on its outer periphery, and said second hollow member has a cylindrical wall in which are provided two diametrically opposing engaging holes near said open end of said second hollow member, said protrusions of said first hollow member capable of engaging in said engaging holes when said first hollow member is inserted in said second hollow member, wherein said second hollow member further has a plate member which is normal to the longitudinal axis of said second hollow member and mounted movably in said second hollow member, and a spring urging said plate towards said open end of said second hollow member.

* * * * *